US009469883B2

(12) United States Patent
Kozawa et al.

(10) Patent No.: US 9,469,883 B2
(45) Date of Patent: Oct. 18, 2016

(54) CARBURIZED STEEL PART HAVING EXCELLENT LOW CYCLE BENDING FATIGUE STRENGTH

(71) Applicants: NIPPON STEEL & SUMITOMO METAL CORPORATION, Chiyoda-Ku, Tokyo (JP); SANYO SPECIAL STEEL CO., LTD., Himeji-shi, Hyogo (JP)

(72) Inventors: Shuji Kozawa, Tokyo (JP); Manabu Kubota, Tokyo (JP); Osamu Kada, Tokyo (JP); Motohiro Nishikawa, Himeji (JP); Takashi Tanaka, Himeji (JP); Norimasa Tsunekage, Himeji (JP)

(73) Assignees: NIPPON STEEL & SUMITOMO METAL CORPORATION, Tokyo (JP); SANYO SPECIAL STEEL CO., LTD., Himeji-shi (JP)

( * ) Notice: Subject to any disclaimer, the term of this patent is extended or adjusted under 35 U.S.C. 154(b) by 280 days.

(21) Appl. No.: 14/014,983

(22) Filed: Aug. 30, 2013

(65) Prior Publication Data

US 2013/0340895 A1 Dec. 26, 2013

Related U.S. Application Data

(63) Continuation of application No. 13/139,000, filed as application No. PCT/JP2010/070516 on Nov. 11, 2010, now abandoned.

(30) Foreign Application Priority Data

Mar. 10, 2010 (JP) ..... 2010-053555

(51) Int. Cl.
*C22C 38/28* (2006.01)
*C22C 38/26* (2006.01)

(Continued)

(52) U.S. Cl.
CPC . *C21D 1/68* (2013.01); *C21D 1/06* (2013.01); *C21D 9/32* (2013.01); *C22C 38/002* (2013.01); *C23C 8/22* (2013.01); *C21D 2211/004* (2013.01); *C21D 2211/008* (2013.01)

(58) Field of Classification Search
None
See application file for complete search history.

(56) References Cited

U.S. PATENT DOCUMENTS

| | | | |
|---|---|---|---|
| 5,853,502 | A | 12/1998 | Aihara et al. |
| 6,126,897 | A | 10/2000 | Aihara et al. |
| 2011/0036463 | A1 | 2/2011 | Miyanishi et al. |

FOREIGN PATENT DOCUMENTS

| | | |
|---|---|---|
| EP | 1876256 | 1/2008 |
| JP | 7-70646 | 3/1995 |

(Continued)

OTHER PUBLICATIONS

Machine—English translation of JP 2009-228049, Ozawa Shuji et al., Oct. 8, 2009.*

(Continued)

*Primary Examiner* — Deborah Yee
(74) *Attorney, Agent, or Firm* — Birch, Stewart, Kolasch & Birch, LLP

(57) ABSTRACT

A carburized steel part having excellent low cycle bending fatigue strength which is comprised of a steel material which contains, by mass %, C: 0.1 to 0.6%, Si: 0.01 to 1.5%, Mn: 0.3 to 2.0, P: 0.02% or less, S: 0.001 to 0.15%, N: 0.001 to 0.03%, Al: 0.001 to 0.06%, and O: 0.005% or less and has a balance of substantially iron and unavoidable impurities and which is carburized and quenched, and then tempered, which steel part has a surface hardness of HV550 to HV800 and a core hardness of HV400 to HV500.

4 Claims, 5 Drawing Sheets

(51) Int. Cl.

| | |
|---|---|
| ***C21D 9/32*** | (2006.01) |
| ***C23C 8/22*** | (2006.01) |
| ***C21D 1/68*** | (2006.01) |
| ***C21D 1/06*** | (2006.01) |
| ***C22C 38/00*** | (2006.01) |

(56) References Cited

FOREIGN PATENT DOCUMENTS

| | | |
|---|---|---|
| JP | 08-092690 | 4/1996 |
| JP | 10-259450 | 9/1998 |
| JP | 2004-238702 | 8/2004 |
| JP | 2005-36269 | 2/2005 |
| JP | 2005-042188 | 2/2005 |
| JP | 2007-332438 | 12/2007 |
| JP | 2008-248284 | 10/2008 |
| JP | 2008-280583 | 11/2008 |
| WO | WO 02/44435 A1 | 6/2002 |
| WO | WO 2010/116670 | 10/2010 |

OTHER PUBLICATIONS

International Search Report dated Feb. 22, 2011 issued in corresponding PCT Application No. PCT/JP2010/070516.

* cited by examiner

CARBURIZED STEEL PART HAVING EXCELLENT LOW CYCLE BENDING FATIGUE STRENGTH

This application is a continuation application of U.S. application Ser. No. 13/139,000, filed Nov. 10, 2011, now abandoned which is a national stage application of International Application No. PCT/JP2010/070516, filed Nov. 11, 2010, which claims priority to Japanese Application No. 2010-053555, filed Mar. 10, 2010, each of which is incorporated by reference in its entirety.

TECHNICAL FIELD

The present invention relates to a carburized steel part having excellent low cycle bending fatigue strength.

BACKGROUND ART

Parts for machine structures, differential gears, transmission gears, toothed carburized shafts, and other gears sometimes break at the tooth bases after low cycle fatigue (fatigue in region of several hundreds to several thousands of cycles) due to sudden starts and sudden stops of the vehicles. In particular, greater improvement of the low cycle fatigue strength is being sought for differential gears and for transmission gears.

In the past, as the steel material for the above steel parts, JIS SCr420, SCM420, and other around C: 0.2% case hardened steel has been used to secure toughness of the core. "Carburizing and quenching" and around 150° C. low temperature tempering are used to form an around C: 0.8% tempered martensite structure on the surface and to improve the high cycle bending fatigue strength and wear resistance.

As a steel part raised in low cycle bending fatigue strength, Patent document 1 discloses a carburized part which contains C: 0.1 to 0.3% and B: 0.005% or less, restricts Si to 0.3% or less and P to 0.03% or less, and gives a core hardness of HV350 or more.

Patent document 2 discloses case hardened steel which restricts C to 0.15 to 0.3%, Si to 0.5% or less, and P to 0.01% or less and makes the sum of the plastic deformation resistance and grain boundary strength, calculated from the composition, to a certain value or more so as to raise the low cycle fatigue strength.

Patent document 3 discloses a carburized gear which has an excellent low cycle fatigue strength which restricts C to 0.1 to 0.3%, B to 0.001 to 0.005%, Si to 0.5% or less, and P to 0.03% or less, and has a core hardness of the tooth roots of HV300 or more.

Patent document 4 discloses a carburized part which restricts C to 0.15 to 0.3%, B to 0.0003 to 0.005%, Si to 0.03 to 0.25%, and P to 0.02% or less and makes the values related to the core hardness which are calculated from the composition of ingredients a certain value or more so as to raise the low cycle impact fatigue characteristic.

Patent document 5 discloses carbonitrided bearing steel which is comprised of C: 0.1 to 0.4%, Si: 1.0% or less, Mn: over 1.5 to 3%, P: 0.03% or less, S: 0.03% or less, Cr: 0.3 to 2.5%, Al: 0.005 to 0.050%, Ti: 0.003% or less, O: 0.0015% or less, N: 0.025% or less, and a balance of unavoidable impurities and Fe and which is carbonitrided or then treated by secondary quenching and tempering to give a surface hardness of 58HRC or more and an amount of surface residual austenite of 20 to 50%.

Patent document 6 discloses a carburized quenched steel material which is excellent in low cycle fatigue characteristics which contains C: 0.1 to 0.4%, Si: 0.02 to 1.3%, Mn: 0.3 to 1.8%, S: 0.001 to 0.15%, Al: 0.001 to 0.05%, N: 0.003 to 0.020%, P: 0.025% or less, and O: 0.0025% or less, which further contains one or more types of Cr: 1.8% or less, Mo: 1.5% or less, Ni: 3.5% or less, B: 0.006% or less, V: 0.5% or less, Nb: 0.04% or less, and Ti: 0.2% or less, and which has a balance of iron and unavoidable impurities, which steel material has a projected core hardness Hp-core defined by the following formula (1) (=Hcore/(1−t/r) [Hcore: core hardness, t: effective hardened layer depth, r: radius of broken portion or half of thickness of broken portion]) of HV390 or more.

Patent document 7 discloses case hardened steel which is excellent in surface fatigue strength of a hydrogen embrittlement type which is comprised of C: 0.1 to 0.4%. Si: 0.5% or less, Mn: 1.5% or less, P: 0.03% or less, S: 0.03% or less, Cr: 0.3 to 2.5%, Mo: 0.1 to 2.0%, V: 0.1 to 2.0%, Al: 0.050% or less, O: 0.0015% or less, N: 0.025% or less, and V+Mo: 0.4 to 3.0%, which has a balance of Fe and unavoidable impurities, and which is carburized, quenched, and tempered, which steel has a surface C concentration after quenching of 0.6 to 1.2%, has a surface hardness of HRC58 to less than 64, and has a ratio of number of fine V-based carbide grains of a grain size of less than 100 nm in the V-based carbide grains which are dispersed and precipitated at the surface of 80% or more.

However, in each carburized steel part, the low cycle bending fatigue strength does not reach the currently sought level of the low cycle bending fatigue strength.

PRIOR ART DOCUMENTS

Patent Documents

Patent document 1: Japanese Patent Publication (A) No. 8-92690

Patent document 2: Japanese Patent Publication (A) No. 10-259450

Patent document 3: WO02/44435

Patent document 4: Japanese Patent Publication (A) No. 2004-238702

Patent document 5: Japanese Patent Publication (A) No. 2005-042188

Patent document 6: Japanese Patent Publication (A) No. 2007-332438

Patent document 7: Japanese Patent Publication (A) No. 2008-280583

SUMMARY OF INVENTION

Problem to be Solved by the Invention

The arts disclosed in Patent documents 1 to 7 cannot answer the current demands for improvement of the low cycle bending fatigue strength. Therefore, the present invention has as its object the provision of a carburized steel part, which is remarkably improved in low cycle bending fatigue strength compared with the conventional low cycle bending fatigue strength.

Means for Solving the Problem

In order to solve the above problem, the inventors carried out in-depth low cycle bending fatigue tests by changing the composition and carburizing characteristics of the steel material over a broad range in a systematic manner. As a result, the inventors obtained the following findings (a) to (d).

(a) To raise the low cycle bending fatigue strength, it is optimal to make the surface hardness HV550 to HV800. Within that range, it is effective to lower the surface hardness.

(b) (b1) To raise the low cycle bending fatigue strength, it is optimal to make the core hardness HV400 to HV500. Within that range, it is effective to make the core hardness higher. Alternatively, (b2) at C: 0.6% or less, the higher the core hardness, the better.

In the past, it has been said that if C is over 0.3%, the toughness falls and the low cycle bending fatigue strength falls, but the inventors found that (b3) the toughness fell not because of the amount of C, but when the core hardness exceeded HV500 and that the 0.6% when the core hardness exceeds HV500 is the upper limit of C.

(c) (c1) To make the low cycle bending fatigue strength higher, it is effective to increase the Si within 0.01 to 1.5% in range.

In the past, Si has been recommended to be kept to 0.5% or less for the reason that it forms a grain boundary oxidized layer at the time of carburizing and invites a drop in strength.

However, the inventors found that (c2) the effect of the grain boundary oxidized layer on the low cycle bending fatigue strength is extremely small if present at all and the increase of the Si is effective against the drop of the surface hardness and/or for the rise of the core hardness.

(d) If greatly reducing the P and adding B, the effects of the above (a) to (c) are further improved.

The present invention was made based on the above findings and has as its gist the following:

(1) A carburized steel part having excellent low cycle bending fatigue strength which is comprised of a steel material which contains, by mass %, C: 0.1 to 0.6%,
Si: 0.01 to 1.5%,
Mn: 0.3 to 2.0%,
P: 0.02% or less,
S: 0.001 to 0.15%,
N: 0.001 to 0.03%,
Al: 0.001 to 0.06%, and
O: 0.005% or less and has
a balance of substantially iron and unavoidable impurities and which is carburized and quenched, and then tempered, said steel part characterized in that it has a surface hardness of HV550 to HV800 and a core hardness of HV400 to HV500.

(2) A carburized steel part having excellent low cycle bending fatigue strength as set forth in the above (1), characterized in that said low cycle bending fatigue strength is 20 kN or more.

(3) A carburized steel part having excellent low cycle bending fatigue strength as set forth in the above (1) or (2), characterized in that said steel material further contains, by mass %, B: 0.0002 to 0.005%.

(4) A carburized steel part having excellent low cycle bending fatigue strength as set forth in any one of the above (1) to (3), characterized in that said steel further contains, by mass %, Cr: 1.20 to 3.0%.

(5) A carburized steel part having excellent low cycle bending fatigue strength as set forth in any one of the above (1) to (4), characterized in that said steel material further contains, by mass %, Ti: 0.01 to 0.2%.

(6) A carburized steel part having excellent low cycle bending fatigue strength as set forth in any one of the above (1) to (5), characterized in that said steel material further contains, by mass %, one or more of Mo: less than 0.1%, Cu: less than 0.1%, and Ni: less than 0.1% as unavoidable ingredients.

(7) A carburized steel part having excellent low cycle bending fatigue strength as set forth in any one of the above (1) to (5), characterized in that said steel material further contains, by mass %, one or more of Mo: 0.1 to 1.5%, Cu: 0.1 to 2.0%, and Ni: 0.1 to 5.0%.

(8) A carburized steel part having excellent low cycle bending fatigue strength as set forth in any one of the above (1) to (7), characterized in that said steel material further contains, by mass %, one or both of Nb: 0.01 to 0.2% and V: 0.03 to 0.2%.

(9) A carburized steel part having excellent low cycle bending fatigue strength as set forth in any one of the above (1) to (8), characterized in that said steel material further contains, by mass %, one or more of Ca: 0.0002 to 0.005%, Zr: 0.0003 to 0.005%, and Mg: 0.0003 to 0.005%.

(10) A carburized steel part having excellent low cycle bending fatigue strength as set forth in any one of the above (1) to (9), characterized in that said carburized steel part is a differential gear or transmission gear.

Effect of the Invention

If using the carburized steel part having excellent low cycle bending fatigue strength of the present invention, it is possible to greatly reduce the size and lighten the weight of automobile-use differential gears and other gears and, as a result, it is possible to improve the fuel economy of automobiles and slash $CO_2$ emissions

MODE FOR CARRYING OUT THE INVENTION

Below, a carburized steel part having excellent low cycle bending fatigue strength of the present invention is explained in detail.

First, the reasons for limiting the composition of the steel material used in the present invention (the invention steel material) is explained. Below, the % in the composition means mass %.

C: 0.1 to 0.6%

C is an element which gives hardness to the core of a steel part which is treated by carburizing and quenching, and which improves the low cycle bending fatigue strength. The structure of the core is a mainly martensite hardened structure. The martensite after quenching becomes harder the greater the amount of C.

Further, when the core hardness is the same, if the amount of C is large, the yield ratio rises by dispersion strengthening of fine carbides. To obtain the effect of addition, C is made 0.1 to 0.6%.

To raise the low cycle bending fatigue strength by making the core hardness HV450 or more, C is preferably 0.2% or more, more preferably over 0.3%. Note that, from the viewpoint of the machineability, C is preferably 0.4% or less.

To improve the fatigue strength of case hardened steel, imparting compressive residual stress is effective. With carburizing and quenching of case hardened steel, the core of around C: 0.2% first expands due to martensite transformation, then the carburized layer of around C: 0.8% expands by martensite transformation, whereby residual stress is left near the surface of the steel part.

Usually, in case hardened steel, if making the amount of C larger like in the present invention, it is believed the difference in amount of C at the core and the carburized layer is reduced, the difference in expansion in martensite transformation becomes smaller, the amount of residual compressive stress is reduced, and as a result the fatigue strength of the steel part falls.

Figure 2:
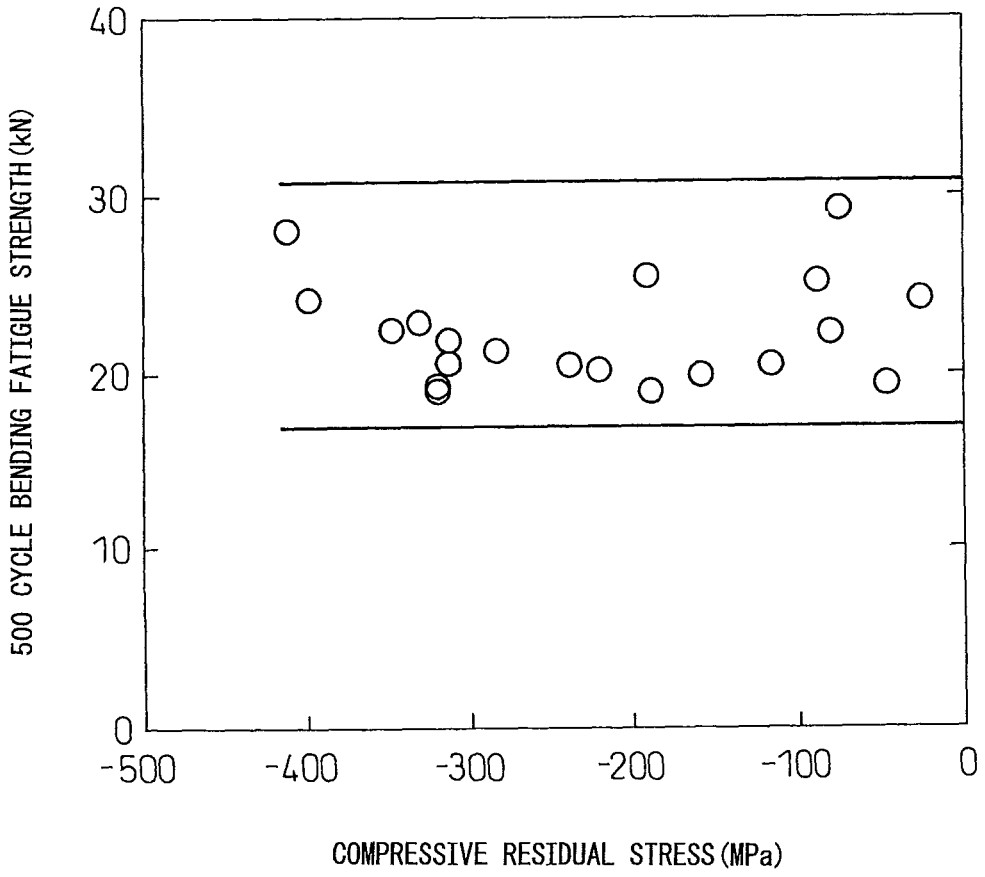
FIG. 2 is a view showing the effects of compressive residual stress (MPa) on a 500 cycle bending fatigue strength (kN).

Therefore, the inventors investigated the effects of compressive residual stress (MPa) on the 500 cycle bending fatigue strength (kN). The results are shown in FIG. 2. As shown in FIG. 2, it was learned that it cannot be said that the compressive residual stress has an effect on the 500 cycle bending fatigue strength.

Si: 0.01 to 1.5%

Si is an element which is effective for deoxidation of the steel material. Further, it is an element which is effective for improving the temper-softening resistance. Furthermore, Si is an element which raises the quenching ability, raises the core hardness of the steel part after carburizing and quenching, and contributes to the improvement of the low cycle bending fatigue strength.

If less than 0.01%, the effect of addition is insufficient, while if over 1.5%, the carburization ability is impaired, so Si is made 0.01 to 1.5%.

When employing, for the carburization, the general gas carburization method of carbon potential 0.7 to 1.0, Si in range of 0.5 to 1.5% increases the activity of C in the steel material and acts to suppress the surface hardness, so is an element which is effective for further improvement of the low cycle bending fatigue strength. For this reason, Si is preferably 0.5 to 1.5%.

In the past, Si has been recommended to be limited to 0.5% or less since it forms a grain boundary oxidized layer at the time of carburization and thereby causes a drop in strength. This is believed, to be based on the conventional belief that if limiting the amount of Si, it is possible to reduce the grain boundary oxidized layer depth and possible to improve the bending fatigue strength in the high cycle region.

Figure 3:
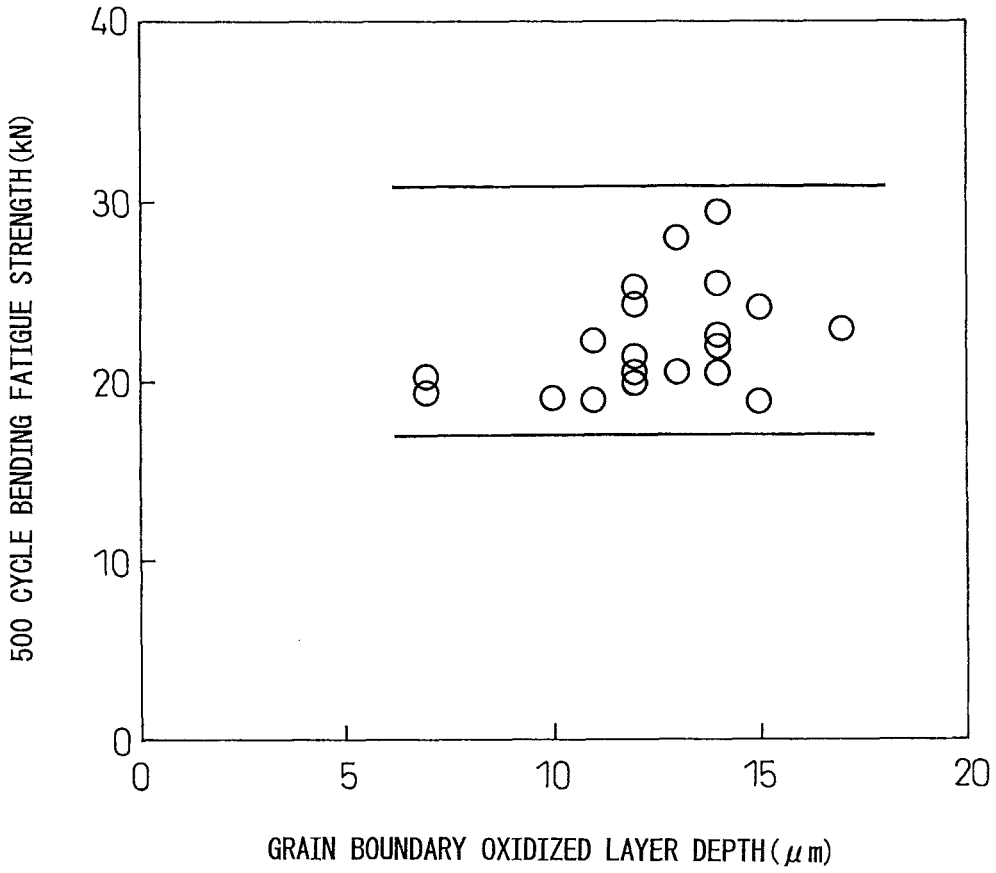
FIG. 3 is a view showing the effects of grain boundary oxidized layer depth (μm) on a 500 cycle bending fatigue strength (kN).

Therefore, the inventors investigated the effects of the grain boundary oxidized layer depth (μm) on a 500 cycle bending fatigue strength (kN). The results are shown in FIG. 3. As shown in FIG. 3, it was learned that the magnitude of the grain boundary oxidized layer depth does not have an effect on the 500 cycle bending fatigue strength.

Mn: 0.3 to 2.0%

Mn is an element which is effective for deoxidation of a steel material and is an element which improves the quenching ability of the steel material to raise the core hardness of a steel part after carburizing and quenching and contribute to the improvement of the low cycle bending fatigue strength.

If less than 0.3%, the effect of addition is insufficient, while if over 2.0%, the effect of addition becomes saturated, so Mn is made 0.3 to 2.0%. Preferably, it is 0.8 to 1.5%.

P: 0.02% or Less

P is an impurity. At the time of carburization, P segregates at the austenite grain boundaries and, due to grain boundary fracture, causes a drop in the low cycle bending fatigue strength. Due to this, P is limited to 0.02% or less. Preferably, it is 0.01% or less.

S: 0.001 to 0.15%

S is an element which forms MnS in a steel, material and contributes to improvement of the machineability. If less than 0.001%, the effect of addition is insufficient, while if over 0.15%, the effect of addition is saturated and, further, the element segregates at the grain boundaries to cause grain boundary embrittlement, so S is 0.001 to 0.15%. Preferably, it is 0.01 to 0.1%.

N: 0.001 to 0.03%

N is an element which bonds with Al, Ti, Nb, V, etc. in the steel material and forms nitrides or carbonitrides which act to suppress coarsening of the crystal grains.

If less than 0.001%, the effect of addition is insufficient, while if over 0.03%, the effect of addition becomes saturated, so N is made 0.001 to 0.03%. Preferably, it is 0.003 to 0.008%.

Al: 0.001 to 0.06%

Al is an element which is added for the purpose of deoxidation of the steel material. If less than 0.001%, the effect of addition is insufficient, while if over 0.06%, the effect of addition becomes saturated, so Al is made 0.001 to 0.06%. Preferably, it is 0.01 to 0.04%.

O: 0-0.005% or Less

O is an element which is unavoidably contained, segregates at the grain boundaries to facilitate grain boundary embrittlement, and easily forms hard oxide-based inclusions causing brittle fracture in the steel material. To prevent grain boundary embrittlement and brittle fracture, O is made 0.005% or less. Preferably, it is 0.002% or less.

The invention steel material contains B to further improve the low cycle bending fatigue strength (20 kN or more).

B: 0.0002 to 0.005%

B is an element which suppresses grain boundary segregation of P, improves the grain boundary strength and intragranular strength and the hardenability to thereby contribute to the improvement of the low cycle bending fatigue strength (20 kN or more).

If less than 0.0002%, the effect of addition is insufficient, while if over 0.005%, the effect of addition becomes saturated, so B is made 0.0002 to 0.005%. Preferably, it is 0.0005 to 0.003%.

The present invention steel material contains Cr to further improve the hardenability and further improve the low cycle bending fatigue strength.

Cr: 1.20 to 3.0%

Cr is an element which improves the hardenability of a steel material to raise the core hardness of a steel part after carburizing and quenching and contribute to the improvement of the low cycle bending fatigue strength. If less than 1.20%, the effect of addition is insufficient, while if over 3.0%, the effect of addition becomes saturated, so Cr is made 1.20 to 3.0%. Preferably, it is 1.50 to 2.5%.

The present invention steel material contains Ti to prevent the crystal grains from coarsening and the low cycle fatigue strength from deteriorating at the time of high temperature carburization.

Ti: 0.005 to 0.2%

Ti is an element which forms fine TiC and/or TiS in a steel material.

Due to the presence of TiC and/or TiS, in high temperature carburization with a carburization temperature of 980° C. or more or long carburization with a carburization time of 10 hours or more, it is possible to stably refine the austenite grains, so it is possible to prevent deterioration of the low cycle fatigue strength.

Further, Ti is an element which bonds with N in a steel material to form TiN so as to prevent the precipitation of BN and contribute to securing solute B.

If less than 0.005%, the effect of addition is insufficient, while if over 0.2%, a large amount of TiN-based precipitates precipitate and the rolling fatigue characteristics fall, so Ti is made 0.005 to 0.2%. Preferably, it is 0.01 to 0.1%.

In the present invention steel material, the unavoidably entering Mo, Cu, and Ni are limited to less than 0.1%. Preferably, they are limited to 0.05% or less, more preferably 0.01% or less.

Mo, Cu, and Ni are elements which act to raise the hardenability so as to raise the low cycle bending fatigue strength, so the required amounts of one or more of Mo, Cu, and Ni may also be contained.

Mo: 0.1 to 1.5%

Mo is an element which raises the hardenability of a steel material, raises the core hardness of a steel part after carburizing and quenching, and contributes to improvement of the low cycle bending fatigue strength. If less than 0.1%, there is no effect, while if over 1.5%, the effect of addition becomes saturated, so Mo is made 0.1 to 1.5%. Preferably, it is 0.3 to 1.2%.

Cu: 0.1 to 2.0%

Cu is an element which raises the hardenability of a steel material so as to raise the core hardness of a steel part after carburizing and quenching and contribute to the improvement of the low cycle bending fatigue strength. If less than 0.1%, the effect of addition is insufficient, while if over 2.0%, the effect of addition becomes saturated, so Cu is made 0.1 to 2.0%. Preferably, it is 0.3 to 1.5%.

Ni: 0.1 to 5.0%

Ni is an element which raises the hardenability of a steel material so as to raise the core hardness of a steel part after carburizing and quenching and contribute to the improvement of the low cycle bending fatigue strength. If less than 0.1%, there is no effect, while if over 5.0%, the effect of addition becomes saturated, so Ni is made 0.1 to 5.0%. Preferably, it is 0.5 to 3.5%.

The present invention steel material further contains one or both of Nb and V to prevent coarsening of the crystal grains at the time of high temperature carburization and the resultant deterioration of the low cycle fatigue strength.

Nb: 0.01 to 0.2%

Nb is an element which forms Nb-carbonitrides in a steel material. Due to the presence of Nb-carbonitrides, it is possible to stably refine austenite grains in high temperature carburization with a carburization temperature of 980° C. or more or long carburization with a carburization time of 10 hours or more, so it is possible to prevent deterioration of the low cycle fatigue strength.

If less than 0.01%, the effect of addition is insufficient, while if over 0.2%, the machineability deteriorates, so Ti is made 0.01 to 0.2%. Preferably, it is 0.02 to 0.1%.

V: 0.03 to 0.2%

V is an element which forms V-carbonitrides in a steel material. Due to the presence of V-carbonitrides, it is possible to stably refine austenite grains in high temperature carburization with a carburization temperature of 980° C. or more or long carburization with a carburization time of 10 hours or more, so it is possible to prevent deterioration of the low cycle fatigue strength.

If less than 0.03%, the effect of addition is insufficient, while if over 0.2%, the machineability deteriorates, so V is made 0.03 to 0.2%. Preferably, it is 0.05 to 0.1%.

The present invention steel material may contain one or more of the required amounts of Ca, Zr, and Mg so as to improve the machineability.

Ca: 0.0002 to 0.005%

Ca is an element which lowers the melting point of the oxides in a steel material. The low melting point oxides soften due to the rise in temperature under a cutting environment and thereby improve the machineability of a steel material.

If less than 0.0002%, there is no effect of addition, while if over 0.005%, a large amount of CaS is formed and the machineability of a steel material falls, so Ca is made 0.0002 to 0.005%. Preferably, it is 0.0008 to 0.003%.

Zr: 0.0003 to 0.005%

Zr is an element, which deoxidizes a steel material and forms oxides and, further, is an element which forms sulfides. Sulfides work with MnS and contribute to improvement of the machineability. Zr-based oxides form nuclei for the precipitation of MnS, so Zr is an element which is effective for control of dispersion of MnS.

Zr is added over 0.003% for spheroidization of MnS, but conversely 0.0003 to 0.005 is added for causing fine dispersion of MnS.

From the viewpoint of the stability of quality in production (ingredient yield etc.), addition of 0.0003 to 0.005% of Zr for causing fine dispersion of MnS is preferable in practice. Note that, if less than 0.0003%, there is almost no effect of addition of Zr.

Mg: 0.0003 to 0.005%

Mg is an element which deoxidizes a steel material and forms oxides and, further, is an element which forms sulfides. Sulfides cooperate with MnS to contribute to the improvement of the machineability.

Mg-based oxides form nuclei for precipitation of MnS. Further, sulfides become composite sulfides of Mn and Mg to thereby suppress deformation of composite sulfides and cause spheroidization, so Mg is an element effective for control of dispersion of MnS.

If less than 0.0003%, there is no effect of addition, while if over 0.005%, large amounts of MgS are formed and the machineability of the steel material falls, so Mg is made 0.0003 to 0.005%. Preferably, it is 0.0008 to 0.003%.

Next, the reasons for limiting the surface hardness and the core hardness in a steel part obtained by carburizing and quenching then tempering of the present invention steel material is explained.

Surface Hardness: HV550 to HV800

Figure 4:
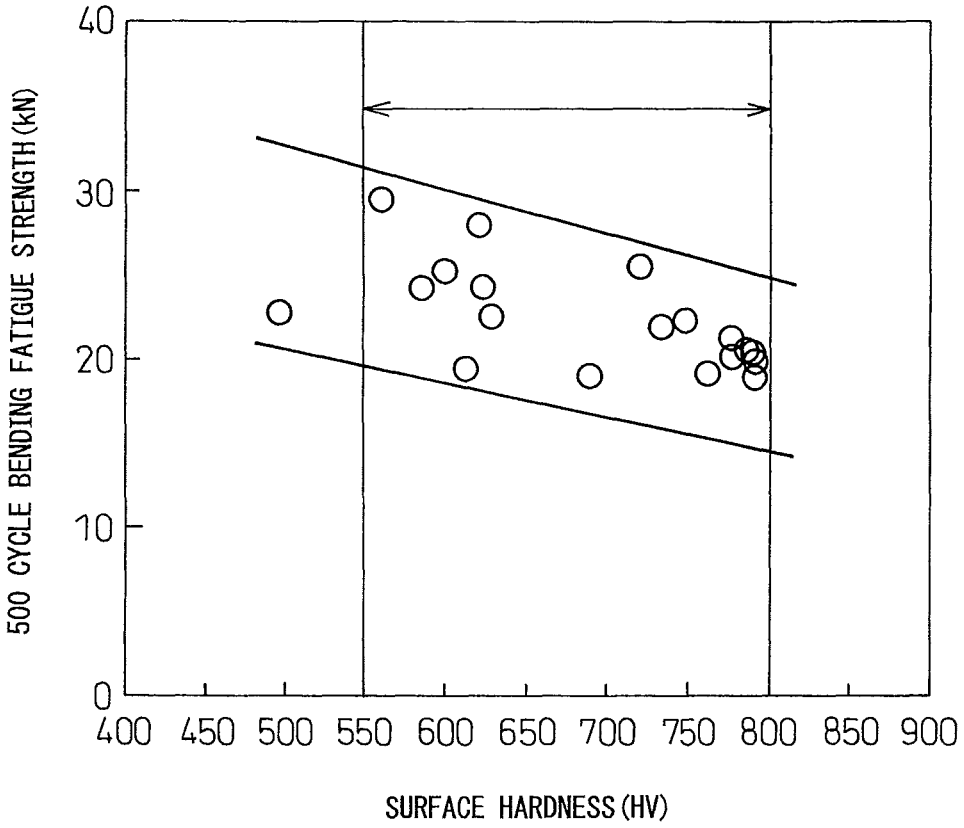
FIG. 4 is a view of the effects of surface hardness (HV) on a 500 cycle bending fatigue strength (kN).

The inventors investigated the effects of the surface hardness (HV) on a 500 cycle bending fatigue strength (kN) in the range of a surface hardness of HV500 to HV800. The results are shown in FIG. 4. From FIG. 4, it is learned that in the range of a surface hardness of HV500 to HV800, the lower the surface hardness, the better the low cycle bending fatigue strength.

The inventors examined the fracture surfaces of fractured parts and as a result learned that (i) if the surface hardness is high, cracks in the brittle fracture surface form from the surface and rapidly propagate, but (ii) if the surface hardness is low, even if cracks form from the surface, the rate of occurrence of a brittle fracture surface is low, so the speed of propagation of cracks is slow and as a result (iii) the low cycle bending fatigue strength is improved.

However, if the surface hardness is less than HV550, the wear resistance is impaired, so the surface hardness is made HV550 to HV800 (see "←→" in figure). Preferably, it is HV600 to HV750, more preferably, it is HV620 to HV720.

Note that, if the surface hardness is over HV800, the toughness of the surface remarkably falls, the speed of propagation of the crack becomes faster, and the low cycle bending fatigue strength falls.

The surface hardness is the hardness of the carburized structure forming a carburized layer. It is possible to adjust the carbon potential at the time of carburization and the tempering temperature after carburizing and quenching so as to adjust the surface hardness.

For example, the inventors carburized and quenched steel parts by a carbon potential of 0.8, then tempered them at 150° C., then ran a low cycle bending fatigue test. When the low cycle bending fatigue strength is lower than a required value, they lowered the carbon potential to 0.7 or raised the tempering temperature to 180° C. to lower the surface hardness and improve the low cycle bending fatigue strength.

Core Hardness: HV400 to HV500 The inventors investigated the effects of the core hardness (HV) on the 500 cycle bending fatigue strength (kN) in the range of a core hardness of HV270 to HV650. The results are shown in FIG. 5.

Figure 5:
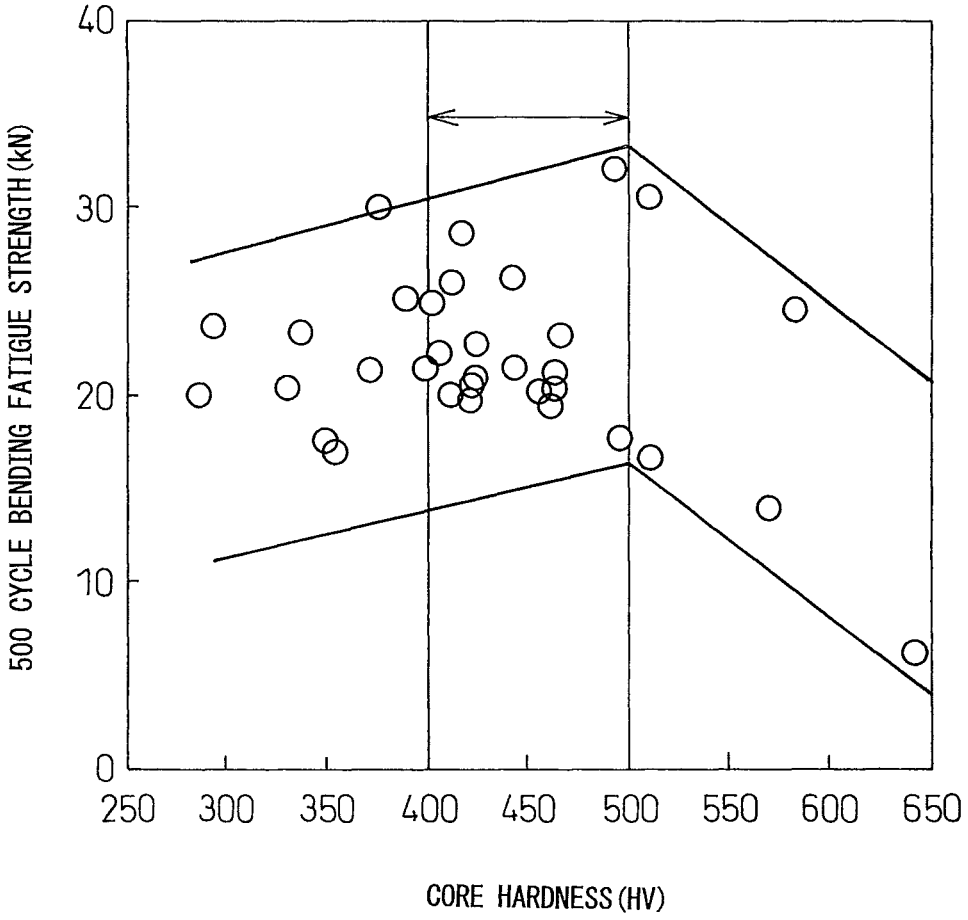
FIG. 5 is a view showing the effects of core hardness (HV) on a 500 cycle bending fatigue strength (kN).

From FIG. 5, it is learned that if the core hardness is HV400 to HV500 in range, the higher the core hardness, the better the low cycle bending fatigue strength.

The inventors examined the fracture surfaces of fractured parts and as a result learned that if the core hardness is low, the core right below the carburized layer (hardened structure) yields, a stress of the stress at the time of yielding or more is not received, and the stress on the carburized layer, that is, the surface of the steel part, rises.

To remarkably raise the low cycle bending fatigue strength over the low cycle bending fatigue strength of the conventional JIS SCr420, SCM420, etc., a core hardness of HV400 or more is required, so the core hardness is made HV400 to HV500 (see "←→" in figure). Preferably, it is HV430 to HV500, more preferably, it is HV450 to HV500.

Note that, if the core hardness is over HV500, the toughness of the core remarkably falls, the speed of propagation of cracks at the core becomes faster, and the low cycle bending fatigue strength falls.

The "core" is the location which the C entering from the surface of a steel part reaches due to carburization. For example, it is the location where the C is increased by 10% from the C in the material (when C of material is 0.20%, 0.22%) to where the C becomes the C in the material. The core can be discriminated by EPMA-C-ray analysis etc.

Note that, the carburization method used does not have to be any special method. The advantageous effects of the present invention are realized even if using general carburization methods such as the gas carburization method, vacuum carburization method, and gas carbonitridation method.

After carburization, if the heating until the austenite region (around 850° C.) for quenching (secondary quenching), the crystal grains become finer and the low cycle bending fatigue strength is further improved.

In the present invention, the surface hardness is provided by the carburized structure while the core hardness is provided by the quenched structure, so the steel material can be given the required carburization ability and hardenability to separately adjust the surface hardness and the core hardness. This point is also a feature of the present invention.

EXAMPLE

Next, examples of the present invention are explained, but the conditions of the examples are illustrations of conditions which are employed for confirming the workability and advantageous effects of the present invention. The present invention is not limited to the illustrations of examples.

The present invention may employ various conditions so long as not outside the gist of the present invention and achieving the object of the present invention.

EXAMPLE

Steel materials of the compositions of ingredients which are shown in Table 1 and Table 2 were drawn, then soaked and normalized to prepare roughly worked test pieces for low cycle bending fatigue tests and roughly worked test pieces for wear tests.

TABLE 1

| Test | | Composition of ingredients (mass %) | | | | | | | | | |
|---|---|---|---|---|---|---|---|---|---|---|---|
| no. | Class | C | Si | Mn | P | S | N | Al | O | B | Cr |
| 1 | Inv. ex. | 0.35 | 0.26 | 0.80 | 0.010 | 0.015 | 0.012 | 0.030 | 0.0010 | — | 1.20 |
| 2 | Inv. ex. | 0.40 | 1.00 | 0.80 | 0.009 | 0.015 | 0.006 | 0.039 | 0.0009 | — | — |
| 3 | Inv. ex. | 0.31 | 0.90 | 0.81 | 0.010 | 0.015 | 0.006 | 0.037 | 0.0012 | 0.0015 | — |
| 4 | Inv. ex. | 0.60 | 0.24 | 0.73 | 0.008 | 0.030 | 0.006 | 0.021 | 0.0006 | — | — |
| 5 | Inv. ex. | 0.35 | 0.01 | 1.20 | 0.009 | 0.031 | 0.004 | 0.010 | 0.0010 | 0.0015 | 1.21 |
| 6 | Inv. ex. | 0.34 | 1.49 | 0.79 | 0.009 | 0.030 | 0.012 | 0.015 | 0.0011 | — | 1.20 |
| 7 | Inv. ex. | 0.33 | 1.02 | 0.30 | 0.010 | 0.016 | 0.004 | 0.022 | 0.0009 | 0.0020 | 1.20 |
| 8 | Inv. ex. | 0.36 | 0.60 | 2.00 | 0.009 | 0.029 | 0.012 | 0.028 | 0.0007 | — | — |
| 9 | Inv. ex. | 0.39 | 1.20 | 0.79 | 0.020 | 0.015 | 0.005 | 0.030 | 0.0011 | 0.0012 | 1.21 |
| 10 | Inv. ex. | 0.40 | 0.90 | 0.81 | 0.008 | 0.149 | 0.012 | 0.031 | 0.0009 | 0.0018 | 1.20 |
| 11 | Inv. ex. | 0.32 | 1.11 | 0.79 | 0.010 | 0.015 | 0.001 | 0.037 | 0.0010 | — | 1.19 |
| 12 | Inv. ex. | 0.38 | 0.79 | 0.80 | 0.010 | 0.028 | 0.029 | 0.010 | 0.0010 | — | — |
| 13 | Inv. ex. | 0.35 | 1.02 | 0.80 | 0.010 | 0.015 | 0.011 | 0.001 | 0.0010 | — | 1.20 |
| 14 | Inv. ex. | 0.40 | 0.99 | 0.79 | 0.010 | 0.016 | 0.012 | 0.060 | 0.0019 | — | 1.21 |
| 15 | Inv. ex. | 0.34 | 1.40 | 0.81 | 0.011 | 0.015 | 0.005 | 0.030 | 0.0009 | 0.0031 | — |
| 16 | Inv. ex. | 0.31 | 0.25 | 0.73 | 0.009 | 0.015 | 0.005 | 0.035 | 0.0049 | 0.0015 | 1.20 |
| 17 | Inv. ex. | 0.35 | 1.00 | 0.81 | 0.010 | 0.031 | 0.005 | 0.039 | 0.0009 | 0.0016 | 1.20 |
| 18 | Inv. ex. | 0.51 | 0.51 | 0.79 | 0.010 | 0.014 | 0.012 | 0.040 | 0.0008 | 0.0050 | 1.20 |
| 19 | Inv. ex. | 0.35 | 1.10 | 0.80 | 0.009 | 0.014 | 0.005 | 0.020 | 0.0010 | 0.0015 | 1.20 |
| 20 | Inv. ex. | 0.35 | 0.25 | 0.80 | 0.010 | 0.015 | 0.013 | 0.031 | 0.0010 | — | 1.06 |

TABLE 1-continued

| | | | | | | | | | | | |
|---|---|---|---|---|---|---|---|---|---|---|---|
| 21 | Inv. ex. | 0.45 | 0.24 | 0.80 | 0.009 | 0.014 | 0.012 | 0.031 | 0.0010 | — | — |
| 22 | Inv. ex. | 0.45 | 0.24 | 0.80 | 0.009 | 0.014 | 0.012 | 0.031 | 0.0010 | — | — |

| Test | | Composition of ingredients (mass %) | | | | | | | | |
|---|---|---|---|---|---|---|---|---|---|---|
| no. | Class | Mo | Cu | Ni | Ti | Nb | V | Ca | Zr | Mg |
| 1 | Inv. ex. | — | — | — | — | — | — | — | — | — |
| 2 | Inv. ex. | — | — | — | — | — | — | — | — | — |
| 3 | Inv. ex. | — | — | — | — | — | — | — | — | — |
| 4 | Inv. ex. | — | — | — | — | — | — | — | — | 0.0004 |
| 5 | Inv. ex. | — | — | — | 0.024 | 0.02 | — | — | — | — |
| 6 | Inv. ex. | — | — | — | — | — | — | — | — | — |
| 7 | Inv. ex. | 0.17 | — | — | 0.025 | 0.05 | — | — | — | — |
| 8 | Inv. ex. | — | 0.50 | — | — | — | — | — | — | — |
| 9 | Inv. ex. | — | — | — | — | — | — | — | — | — |
| 10 | Inv. ex. | — | — | — | 0.024 | — | — | — | — | — |
| 11 | Inv. ex. | — | — | — | — | — | — | — | — | — |
| 12 | Inv. ex. | — | — | 3.60 | — | — | — | — | — | — |
| 13 | Inv. ex. | — | — | — | — | — | — | — | — | — |
| 14 | Inv. ex. | — | — | — | — | — | — | — | — | — |
| 15 | Inv. ex. | — | — | — | 0.024 | 0.20 | — | — | 0.0005 | — |
| 16 | Inv. ex. | — | — | — | — | — | — | — | — | — |
| 17 | Inv. ex. | — | — | — | 0.198 | — | — | — | — | — |
| 18 | Inv. ex. | — | — | — | — | — | — | — | — | — |
| 19 | Inv. ex. | — | — | — | 0.024 | — | 0.10 | 0.0003 | | |
| 20 | Inv. ex. | 0.22 | — | 0.50 | — | — | — | — | — | — |
| 21 | Inv. ex. | — | — | — | — | — | — | 0.0002 | 0.0004 | — |
| 22 | Inv. ex. | — | — | — | — | — | — | 0.0002 | 0.0004 | — |

TABLE 2

| Test | | Composition of ingredients (mass %) | | | | | | | | | |
|---|---|---|---|---|---|---|---|---|---|---|---|
| no. | Class | C | Si | Mn | P | S | N | Al | O | B | Cr |
| 23 | Comp. ex. | 0.61 | 1.01 | 0.81 | 0.009 | 0.015 | 0.014 | 0.032 | 0.0010 | — | 1.20 |
| 24 | Comp. ex. | 0.35 | 1.56 | 0.81 | 0.009 | 0.015 | 0.005 | 0.035 | 0.0009 | 0.0015 | 1.21 |
| 25 | Comp. ex. | 0.34 | 1.02 | 0.80 | 0.023 | 0.015 | 0.013 | 0.030 | 0.0011 | — | 1.20 |
| 26 | Comp. ex. | 0.35 | 0.26 | 0.80 | 0.010 | 0.015 | 0.012 | 0.020 | 0.0010 | — | 1.20 |
| 27 | Comp. ex. | 0.60 | 0.24 | 0.73 | 0.008 | 0.030 | 0.006 | 0.021 | 0.0006 | — | — |
| 28 | Inv. ex. | 0.10 | 1.26 | 0.73 | 0.020 | 0.016 | 0.015 | 0.031 | 0.0013 | — | 1.05 |
| 29 | Inv. ex. | 0.15 | 0.25 | 0.45 | 0.022 | 0.016 | 0.015 | 0.035 | 0.0013 | — | 0.84 |
| 30 | Inv. ex. | 0.29 | 1.01 | 0.72 | 0.010 | 0.015 | 0.004 | 0.028 | 0.0015 | 0.0016 | 1.05 |
| 31 | Inv. ex. | 0.21 | 0.26 | 0.73 | 0.010 | 0.016 | 0.015 | 0.032 | 0.0011 | — | 1.05 |
| 32 | Inv. ex. | 0.20 | 0.25 | 0.72 | 0.010 | 0.016 | 0.005 | 0.031 | 0.0010 | 0.0018 | 1.07 |
| 33 | Inv. ex. | 0.20 | 1.02 | 0.73 | 0.009 | 0.016 | 0.005 | 0.032 | 0.0010 | 0.0017 | 2.48 |
| 34 | Inv. ex. | 0.20 | 1.00 | 0.73 | 0.010 | 0.015 | 0.004 | 0.027 | 0.0009 | 0.0019 | 1.05 |
| 35 | Inv. ex. | 0.20 | 0.99 | 0.74 | 0.009 | 0.015 | 0.005 | 0.031 | 0.0009 | 0.0020 | 2.48 |
| 36 | Inv. ex. | 0.20 | 0.26 | 0.40 | 0.008 | 0.010 | 0.003 | 0.031 | 0.0011 | 0.0016 | 1.64 |
| 37 | Inv. ex. | 0.23 | 0.26 | 0.40 | 0.009 | 0.010 | 0.003 | 0.027 | 0.0010 | 0.0018 | 1.64 |
| 38 | Inv. ex. | 0.20 | 0.12 | 0.40 | 0.010 | 0.010 | 0.002 | 0.023 | 0.0011 | 0.0018 | 1.63 |
| 39 | Inv. ex. | 0.21 | 0.48 | 0.40 | 0.009 | 0.011 | 0.002 | 0.025 | 0.0010 | 0.0017 | 1.64 |
| 40 | Inv. ex. | 0.21 | 0.25 | 0.40 | 0.009 | 0.010 | 0.003 | 0.028 | 0.0009 | 0.0016 | 1.64 |
| 41 | Inv. ex. | 0.20 | 0.25 | 0.40 | 0.015 | 0.011 | 0.004 | 0.028 | 0.0011 | 0.0017 | 1.63 |
| 42 | Inv. ex. | 0.20 | 0.25 | 0.40 | 0.033 | 0.010 | 0.002 | 0.025 | 0.0008 | 0.0018 | 1.63 |
| 43 | Inv. ex. | 0.15 | 0.26 | 0.40 | 0.009 | 0.010 | 0.003 | 0.026 | 0.0012 | 0.0016 | 1.62 |
| 44 | Inv. ex. | 0.18 | 0.42 | 0.41 | 0.015 | 0.015 | 0.006 | 0.033 | 0.0009 | 0.0010 | 1.85 |

| Test | | Composition of ingredients (mass %) | | | | | | | | |
|---|---|---|---|---|---|---|---|---|---|---|
| no. | Class | Mo | Cu | Ni | Ti | Nb | V | Ca | Zr | Mg |
| 23 | Comp. ex. | — | — | — | — | — | — | — | — | — |
| 24 | Comp. ex. | — | — | — | 0.024 | 0.03 | — | — | — | — |
| 25 | Comp. ex. | — | — | — | — | — | — | — | — | — |
| 26 | Comp. ex. | — | — | — | — | — | — | — | — | — |
| 27 | Comp. ex. | — | — | — | — | — | — | — | — | 0.0004 |
| 28 | Inv. ex. | 0.50 | — | — | — | — | — | 0.0015 | — | — |
| 29 | Inv. ex. | 0.22 | — | — | — | — | — | — | — | — |
| 30 | Inv. ex. | — | — | — | 0.028 | 0.03 | — | — | — | — |
| 31 | Inv. ex. | 1.00 | — | — | — | — | — | — | — | — |
| 32 | Inv. ex. | 0.99 | — | — | 0.033 | 0.03 | — | — | — | — |
| 33 | Inv. ex. | — | — | — | 0.029 | 0.03 | — | — | — | — |
| 34 | Inv. ex. | 1.00 | — | — | 0.034 | 0.03 | — | — | — | — |
| 35 | Inv. ex. | 0.99 | — | — | 0.033 | 0.03 | — | — | — | — |

TABLE 2-continued

| | | | | | | | | | | |
|---|---|---|---|---|---|---|---|---|---|---|
| 36 | Inv. ex. | — | — | — | 0.101 | 0.04 | — | — | — | — |
| 37 | Inv. ex. | — | — | — | 0.030 | 0.04 | — | 0.0008 | — | — |
| 38 | Inv. ex. | — | — | — | 0.028 | 0.04 | — | — | — | — |
| 39 | Inv. ex. | — | — | — | 0.133 | — | — | — | — | — |
| 40 | Inv. ex. | — | 0.20 | — | 0.150 | 0.04 | — | — | — | — |
| 41 | Inv. ex. | — | — | — | 0.030 | 0.03 | — | — | — | — |
| 42 | Inv. ex. | — | — | — | 0.030 | 0.04 | — | — | — | — |
| 43 | Inv. ex. | — | — | — | 0.030 | 0.04 | — | 0.0048 | — | — |
| 44 | Inv. ex. | — | 0.10 | 0.20 | 0.021 | 0.03 | — | — | — | — |

Roughly worked test pieces of Test Nos. 1 to 21 (invention examples), Test Nos. 23 to 25 (comparative examples), and Test Nos. 28 to 44 (invention examples) were carburized in a conversion type gas carburization furnace at 930° C. for 5 hours, then were quenched by oil at 130° C.

A roughly worked test piece of Test No. 22 (invention example) was carburized in a conversion type gas carburization furnace at 930° C. for 5 hours, then were quenched by oil at 130° C., then heated at 850° C. for 0.5 hour, then quenched by oil at 130° C.

A roughly worked test piece of Test No. 26 (comparative example) was carburized in a conversion type gas carburization furnace at 930° C. for 5 hours, then were quenched by oil at 220° C.

A roughly worked test piece of Test No. 27 (comparative example) was carburized in a conversion type gas carburization furnace at 930° C. for 5 hours, then were quenched by oil at 30° C., then tempered for 1.5 hours.

Note that, the carbon potential at the time of carburization was adjusted to 0.5 to 0.8 in range and the tempering temperature was adjusted to 150 to 300° C. in range to adjust the surface hardness and the core hardness.

Figure 1:
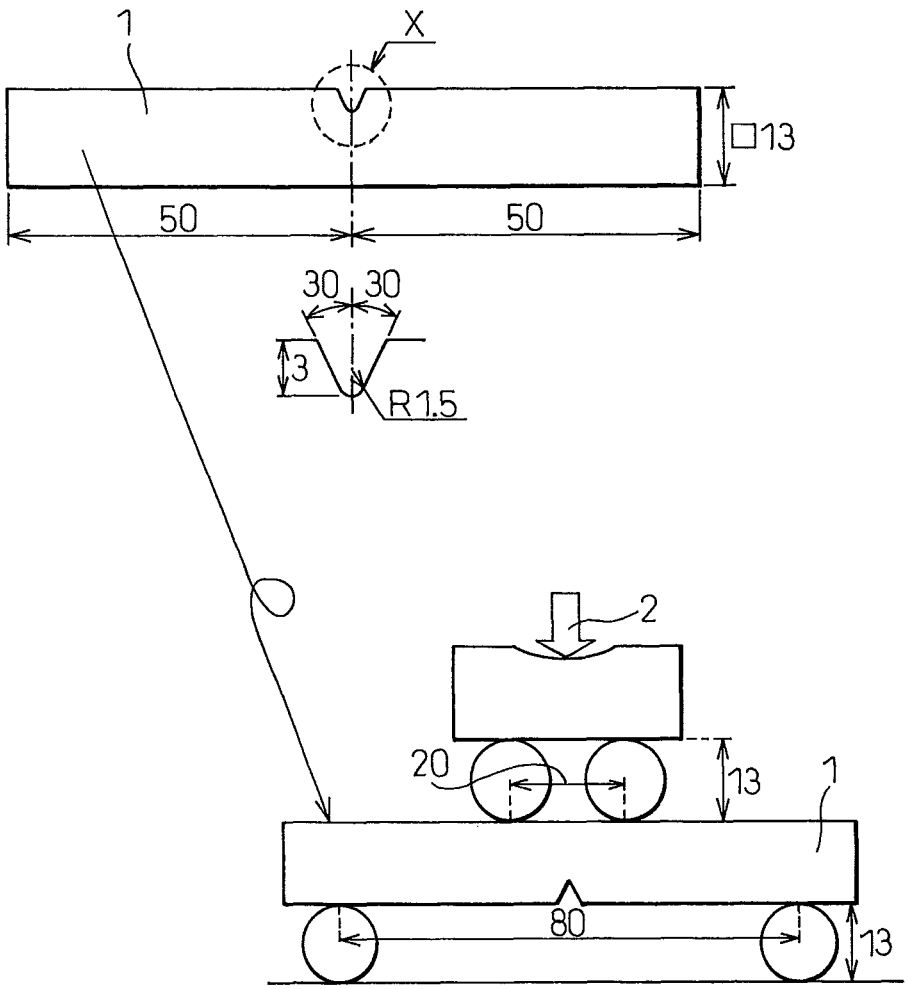
FIG. 1 is a view showing a low cycle bending fatigue test piece and a low cycle bending fatigue test method.

After heat treatment, roughly worked test pieces for low cycle bending fatigue test use were machined to remove only the carburized layer at the side surfaces to prepare 13 mm square notched test pieces 1 (low cycle bending fatigue test pieces) shown in FIG. 1.

For roughly worked test pieces for wear tests, just the gripping parts were machined off to prepare test pieces having cylindrical parts of diameters of 26 mm and widths of 8 mm (wear test pieces).

The low cycle bending fatigue test pieces were measured for surface hardness (HV) and core hardness (HV). The results are shown in Table 3. Note that, the wear test pieces had surface hardnesses equivalent to the surface hardnesses of the low cycle bending fatigue test pieces.

The low cycle bending fatigue test, as shown in FIG. 1, was performed by subjecting a 13 mm square low cycle bending fatigue test piece 1 having a notch X to a four-point bending fatigue test giving a load 2 of a stress ratio 0.1 by a sine wave of a frequency of 1 Hz.

The frequency of 1 Hz (by strain rate of 0.01 $s^{-1}$ or so) is smaller than the actual strain rate which is applied to an automobile-use gear, but in general the repetition rate has an effect on the fatigue test value in the region where the strain rate is 10 $s^{-1}$ or more, and 10 $s^{-1}$ is far larger than the strain rate which is actually applied to an automobile-use gear, so evaluation by a frequency 1 Hz is not obstructed.

Note that, at the time of a test at a frequency of 1 Hz, the test piece did not generate heat as confirmed by separate actual measurement of the temperature of the test piece.

The actual stress ratio of an automobile use gear is 0, but in the present time, the stress ratio is made 0.1 for the reason of preventing horizontal slipping of the test piece at the time of removing the load at the time of a test.

The present test was conducted by a load at which the piece fractures at $10^2$ to $10^4$ cycles. The 500 cycle bending fatigue strength (kN), found by interpolation of the test results, was used as the low cycle bending fatigue strength. The low cycle bending fatigue strength is shown together in Table 3.

TABLE 3

| Test no. | Class | Surface hardness (HV) | Core hardness (HV) | Low cycle bending fatigue strength (kN) | Wear depth (μm) |
|---|---|---|---|---|---|
| 1 | Inv. ex. | 755 | 449 | 21 | 10 |
| 2 | Inv. ex, | 745 | 495 | 22 | 9 |
| 3 | Inv. ex. | 735 | 405 | 21 | 12 |
| 4 | Inv. ex. | 740 | 499 | 23 | 12 |
| 5 | Inv. ex. | 720 | 480 | 22 | 10 |
| 6 | Inv. ex, | 654 | 450 | 23 | 15 |
| 7 | Inv. ex. | 715 | 475 | 22 | 13 |
| 8 | Inv. ex, | 705 | 480 | 23 | 15 |
| 9 | Inv. ex. | 590 | 482 | 25 | 19 |
| 10 | Inv. ex. | 711 | 490 | 23 | 10 |
| 11 | Inv. ex. | 735 | 430 | 22 | 9 |
| 12 | Inv. ex. | 643 | 446 | 24 | 18 |
| 13 | Inv. ex. | 760 | 466 | 21 | 8 |
| 14 | Inv. ex. | 720 | 495 | 23 | 8 |
| 15 | Inv. ex. | 551 | 495 | 26 | 19 |
| 16 | Inv. ex. | 732 | 446 | 22 | 12 |
| 17 | Inv. ex. | 703 | 481 | 23 | 13 |
| 18 | Inv. ex. | 715 | 481 | 23 | 13 |
| 19 | Inv. ex. | 701 | 490 | 23 | 15 |
| 20 | Inv. ex. | 705 | 450 | 24 | 9 |
| 21 | Inv. ex. | 742 | 492 | 22 | 9 |
| 22 | Inv. ex. | 740 | 491 | 30 | 5 |
| 23 | Comp. ex. | 763 | 560 | 10 | 8 |
| 24 | Comp. ex. | 543 | 496 | 21 | 65 |
| 25 | Comp. ex. | 745 | 480 | 15 | 9 |
| 26 | Comp. ex. | 750 | 398 | 16 | 9 |
| 27 | Comp. ex. | 753 | 565 | 11 | 10 |
| 28 | Inv. ex. | 651 | 405 | 23 | 15 |
| 29 | Inv. ex. | 630 | 422 | 21 | 18 |
| 30 | Inv. ex. | 778 | 468 | 26 | 6 |
| 31 | Inv. ex. | 787 | 410 | 20 | 6 |
| 32 | Inv. ex. | 783 | 435 | 21 | 5 |
| 33 | Inv. ex. | 765 | 450 | 23 | 9 |
| 34 | Inv. ex. | 776 | 456 | 21 | 6 |
| 35 | Inv. ex. | 769 | 478 | 21 | 8 |
| 36 | Inv. ex. | 770 | 441 | 27 | 8 |
| 37 | Inv. ex. | 750 | 462 | 20 | 10 |
| 38 | Inv. ex. | 741 | 424 | 23 | 10 |
| 39 | Inv. ex. | 759 | 438 | 28 | 9 |
| 40 | inv. ex. | 782 | 403 | 22 | 6 |
| 41 | Inv. ex. | 768 | 436 | 23 | 6 |
| 42 | Inv. ex, | 750 | 438 | 21 | 10 |
| 43 | Inv. ex, | 775 | 420 | 21 | 6 |
| 44 | Inv. ex. | 733 | 432 | 20 | 11 |

The wear test was conducted by pushing bearing steel (SUJ2) rollers having a diameter of 130 mm, a width of 18 mm, and an R=150 mm crowning at the outer circumference against the wear test piece by a surface pressure of a Hertz stress of 1500 MPa, making the circumferential speed directions of the two rollers at the contact part the same, making the slip rate −100% (circumferential speed of contact part of rollers greater than 100% compared with wear test piece) for rotation, and measuring the wear depth of the wear test piece after the number of rotations reaches 1 million. The results are shown together in Table 3.

As shown in Table 3, Test Nos. 1 to 22 and 28 to 44 of invention examples have an excellent low cycle bending fatigue strength of 20 kN or more and an excellent wear depth of 20 μm or less.

As opposed to this, in Test No. 23 of a comparative example, the low cycle bending fatigue strength is low. This is due to the C of the steel material being over 0.6% and consequently the core hardness rising.

In Test No. 24 of a comparative example, the wear depth is large. This is due to the Si of the steel material being over 1.5% and consequently the carburization ability being blocked and the surface hardness becoming lower.

In Test No. 25 of a comparative example, the low cycle bending fatigue strength is low. This is due to the P of the steel material being over 0.02% and consequently the P segregating at the grain boundaries and grain boundary fracture occurring.

In Test No. 26 of a comparative example, the low cycle bending fatigue strength is low. This is due to the fact that while the composition of ingredients of the steel material is in the scope of the present invention, the core hardness fell below HV400.

The reason why the core hardness fell below HV400 was because the temperature of the quenching oil was a high 220° C. and the quenching became insufficient.

In Test No. 27 of a comparative example, the low cycle bending fatigue strength is low. This is due to the fact that while the composition of ingredients of the steel material is in the scope of the present invention, the core hardness was over HV550.

The reason why the core hardness exceeded HV550 was that the amount of C was a relatively high 0.6%, plus the temperature of the quenching oil was a low 20° C.

INDUSTRIAL APPLICABILITY

As explained above, if using the carburized steel part having excellent low cycle bending fatigue strength of the present invention, it is possible to greatly reduce the size and lighten the weight of automobile-use differential gears and other gears. As a result, it becomes possible to improve the fuel economy of automobiles and slash $CO_2$ emissions. Accordingly, the effect of the present invention is extremely remarkable. The present invention has greater industrial applicability.

REFERENCE SIGNS LIST

1 test piece
2 load
X notch.

The invention claimed is:

1. A carburized steel part having excellent low cycle bending fatigue strength which is comprised of a steel material consisting of, by mass %, C: 0.45 to 0.6%,
Si: 0.06 to 1.5%,
Mn: 0.3 to 2.0%,
P: 0.02% or less,
S: 0.001 to 0.15%,
N: 0.001 to 0.03%,
Al: 0.001 to 0.06%,
Ti: 0.01 to 0.2%,
B: 0.0002 to 0.005%,
Cr: 1.2 to 3.0%,
Ca: 0.0002 to 0.005%,
O: 0.005% or less and
Cu: 0.1 to 2.0, and
one or both of Nb: 0.01 to 0.2% and V: 0.03 to 0.2%, and
a balance of substantially iron and unavoidable impurities,
wherein the steel material which is carburized, quenched, and then tempered,
wherein said carburized steel part has a surface hardness of HV550 to HV800, and a core hardness of HV400 to HV500.

2. The carburized steel part having excellent low cycle bending fatigue strength as set forth in claim 1, wherein said low cycle bending fatigue strength is 20 kN or more.

3. The carburized steel part having excellent low cycle bending fatigue strength as set forth in claim 1, wherein said carburized steel part is a differential gear or transmission gear.

4. The carburized steel part having excellent low cycle bending fatigue strength as set forth in claim 2, wherein said carburized steel part is a differential gear or transmission gear.

* * * * *